US010981746B2

(12) United States Patent
Fujisawa

(10) Patent No.: US 10,981,746 B2
(45) Date of Patent: Apr. 20, 2021

(54) COATING FILM TRANSFER TOOL

(71) Applicant: Tombow Pencil Co., Ltd., Tokyo (JP)

(72) Inventor: Hiromichi Fujisawa, Toyokawa (JP)

(73) Assignee: Tombow Pencil Co., Ltd., Tokyo (JP)

( * ) Notice: Subject to any disclaimer, the term of this patent is extended or adjusted under 35 U.S.C. 154(b) by 257 days.

(21) Appl. No.: 16/026,322

(22) Filed: Jul. 3, 2018

(65) Prior Publication Data

US 2019/0010009 A1 Jan. 10, 2019

(30) Foreign Application Priority Data

Jul. 4, 2017 (JP) ..... JP2017-131409

(51) Int. Cl.
*B65H 35/00* (2006.01)
*B65H 37/00* (2006.01)
(Continued)

(52) U.S. Cl.
CPC ..... *B65H 35/0033* (2013.01); *B43L 19/0068* (2013.01); *B65H 16/005* (2013.01); *B65H 23/00* (2013.01); *B65H 37/007* (2013.01); *B65H 2402/20* (2013.01); *B65H 2402/31* (2013.01); *B65H 2402/631* (2013.01); *B65H 2515/34* (2013.01)

(58) Field of Classification Search
CPC ..... B65H 35/0033; B65H 37/007; B65H 16/005; B65H 23/00; B65H 2402/31; B65H 2402/20; B65H 2515/34; B65H 2402/631; B43L 19/0068; B43L 19/00
See application file for complete search history.

(56) References Cited

U.S. PATENT DOCUMENTS 4,959,046 A 9/1990 Brunetto et al.
5,234,734 A 8/1993 Hamada
(Continued)

FOREIGN PATENT DOCUMENTS

EP 0427870 A1 11/1991
EP 1273544 A1 1/2003
(Continued)

OTHER PUBLICATIONS

US Patent Office, Office Action dated Mar. 25, 2020 in U.S. Appl. No. 16/628,238, which is related to this US Application.
(Continued)

*Primary Examiner* — William A. Rivera
(74) *Attorney, Agent, or Firm* — Kolitch Romano LLP

(57) ABSTRACT

A coating film transfer tool may include a casing that houses a feeding reel around which a transferable tape is wound and a winding reel; and a transfer head having a main body portion arranged in a front side which is one side of a front-rear direction of the casing to extend in a left-right direction perpendicular to the front-rear direction in a front end portion and provided with a pressing edge portion adapted for transferring the coating film to a transfer target surface. The casing or a base member housed in the casing may have a protruding tip that extends to the transfer head side and is connected to the transfer head. The protruding tip may press a part of an area including a center of the left-right direction of the main body portion to the transfer target surface side in the event of a transfer.

20 Claims, 9 Drawing Sheets

(51) Int. Cl.

| | |
|---|---|
| ***B65H 19/00*** | (2006.01) |
| ***B65H 16/00*** | (2006.01) |
| ***B65H 23/00*** | (2006.01) |
| ***B43L 19/00*** | (2006.01) |

(56) References Cited

U.S. PATENT DOCUMENTS

| | | | | |
|---|---|---|---|---|
| 5,597,633 | A | 1/1997 | Mecke et al. | |
| 5,759,341 | A | 6/1998 | Kobayashi | |
| 5,785,437 | A | 7/1998 | Koyama et al. | |
| 5,792,263 | A | 8/1998 | Koyama et al. | |
| 5,820,728 | A * | 10/1998 | Stevens | B65H 37/007 156/577 |
| 5,991,568 | A | 11/1999 | Ziegelmuller et al. | |
| 6,273,169 | B1 * | 8/2001 | Ono | B65H 37/007 118/257 |
| 6,444,266 | B1 | 9/2002 | Mizuno | |
| 6,510,884 | B1 | 1/2003 | Chan | |
| 6,776,209 | B1 * | 8/2004 | You | B65H 37/007 118/257 |
| 7,070,051 | B2 | 7/2006 | Kanner et al. | |
| 7,228,882 | B2 | 6/2007 | Marschand et al. | |
| 9,821,347 | B2 | 11/2017 | Nakane | |
| 9,969,590 | B2 | 5/2018 | Fujisawa | |
| 2002/0088554 | A1 | 7/2002 | Bouveresse et al. | |
| 2003/0062135 | A1 * | 4/2003 | Takahashi | B44C 1/105 156/577 |
| 2005/0056376 | A1 | 3/2005 | Marschand et al. | |
| 2005/0150606 | A1 | 7/2005 | Marschand et al. | |
| 2006/0251888 | A1 | 11/2006 | Lane et al. | |
| 2006/0251889 | A1 | 11/2006 | Lane et al. | |
| 2006/0251890 | A1 | 11/2006 | Lane et al. | |
| 2006/0263596 | A1 | 11/2006 | Bamborough et al. | |
| 2007/0113987 | A1 * | 5/2007 | Ushijima | B65H 37/007 156/577 |
| 2007/0218276 | A1 | 9/2007 | Hiramatsu et al. | |
| 2007/0231571 | A1 | 10/2007 | Lane et al. | |
| 2009/0026302 | A1 | 1/2009 | Kinugasa et al. | |
| 2009/0050275 | A1 | 2/2009 | Sakanishi | |
| 2009/0185849 | A1 | 7/2009 | Narita | |
| 2009/0205785 | A1 | 8/2009 | Rolion et al. | |
| 2010/0084095 | A1 | 4/2010 | Sekiya et al. | |
| 2010/0139707 | A1 | 6/2010 | Boonstra et al. | |
| 2011/0244136 | A1 | 10/2011 | Ryabova | |
| 2012/0267047 | A1 | 10/2012 | Maus et al. | |
| 2014/0023858 | A1 | 1/2014 | Igarashi et al. | |
| 2014/0318700 | A1 | 10/2014 | Henderson et al. | |
| 2017/0247792 | A1 | 8/2017 | Kobashi | |
| 2018/0015775 | A1 | 1/2018 | Tamura | |

FOREIGN PATENT DOCUMENTS

| | | | | |
|---|---|---|---|---|
| JP | H0288057 | A | 3/1990 | |
| JP | 05-178525 | A | 7/1993 | |
| JP | 06073025 | U | 10/1994 | |
| JP | 09071097 | A | 3/1997 | |
| JP | H09-71097 | A | 3/1997 | |
| JP | 2876301 | B2 | 4/1997 | |
| JP | H09-104562 | A | 4/1997 | |
| JP | 09124219 | A | 5/1997 | |
| JP | H09-124219 | A | 5/1997 | |
| JP | H10-52995 | A | 2/1998 | |
| JP | 10-181289 | A | 7/1998 | |
| JP | 10217688 | A | 8/1998 | |
| JP | 11-1095 | A | 1/1999 | |
| JP | 11001095 | A | 1/1999 | |
| JP | 2001240812 | A | 9/2001 | |
| JP | 2002264587 | A * | 9/2002 | B65H 37/007 |
| JP | 2002274097 | * | 9/2002 | B65H 37/007 |
| JP | 2004299602 | A | 10/2004 | |
| JP | 2005-47201 | A | 2/2005 | |
| JP | 2005047201 | A | 2/2005 | |
| JP | 2006123544 | A | 5/2006 | |
| JP | 2006281495 | A | 10/2006 | |
| JP | 3870986 | B2 | 1/2007 | |
| JP | 2007154022 | A | 6/2007 | |
| JP | 2007295776 | A | 11/2007 | |
| JP | 2007307874 | A | 11/2007 | |
| JP | 2008096389 | A | 4/2008 | |
| JP | 2008162052 | A | 7/2008 | |
| JP | 4144798 | B2 | 9/2008 | |
| JP | 2009083403 | A | 4/2009 | |
| JP | 2010002733 | A | 1/2010 | |
| JP | 2010037936 | A | 2/2010 | |
| JP | 2011-121204 | A | 6/2011 | |
| JP | 2011-245696 | A | 12/2011 | |
| JP | 2012195747 | A | 10/2012 | |
| JP | 2014011139 | A | 1/2014 | |
| JP | 2016-124131 | A | 7/2016 | |
| JP | 6247199 | B2 | 12/2017 | |
| WO | 9615060 | A1 | 5/1996 | |

OTHER PUBLICATIONS

Sep. 15, 2015, International Search Report and Written Opinion of the International Searching Authority from the Japan Patent Office in PCT/JP2015/068430, which is an international application of Applicant Tombow Pencil Co., Ltd.

Oct. 6, 2015, International Search Report and Written Opinion of the International Searching Authority from the Japan Patent Office, dated Oct. 6, 2015, in PCT/JP2015/068432, which is s an international application of Applicant Tombow Pencil Co., Ltd.

Jun. 27, 2017, International Search Report and Written Opinion of the International Searching Authority from the Japan Patent Office in PCT/JP2017/011867, which is an international application of Applicant Tombow Pencil Co., Ltd.

Aug. 3, 2018, Non-final Office Action from the United States Patent Office, in U.S. Appl. No. 15/539,863, which is a co-pending application of Applicant Tombow Pencil Co., Ltd.

Apr. 19, 2019, final Office Action from the United States Patent Office, in U.S. Appl. No. 15/539,863, which is a co-pending application of Applicant Tombow Pencil Co., Ltd.

Apr. 25, 2019, Non-final Office Action from the United States Patent Office, in U.S. Appl. No. 15/534,698, which is a co-pending application of Applicant Tombow Pencil Co., Ltd.

Nov. 8, 2018, European Search Report from the European Patent Office in EP18181354, which is a foreign application corresponding to this U.S. application.

* cited by examiner

COATING FILM TRANSFER TOOL

CROSS-REFERENCE TO RELATED APPLICATION

This application claims priority to Japanese Patent Application No. 2017-131409, filed Jul. 4, 2017, which is hereby incorporated by reference.

BACKGROUND

In general, a casing of a coating film transfer tool houses a feeding reel around which a transferable tape for holding a coating film on one surface is wound and a winding reel that winds the transferable tape after transferring the coating film. The transferable tape is extracted from the feeding reel, and the coating film is transferred to a transfer target surface of a transfer head protruding from the casing. Then, the transferable tape is wound around the winding reel.

Here, in order to appropriately transfer the coating film to the transfer target surface, a pressing edge portion provided in a front end of the transfer head for pressing the transferable tape has to press the transfer target surface with a uniform force.

However, if the pressing force becomes ununiform across a left-right direction (width direction) of the pressing edge portion of the transfer head in an actual transfer work, the coating film may not be transferred to the center of the coating film (so called "center dropout"). In addition, the ununiform pressing force may generate an insufficient adhering portion on the transfer target surface of the coating film so that cracking may occur in the transferred coating film, or chipping of the coating film may occur during writing disadvantageously.

That is, when the pressing force becomes ununiform across the left-right direction of the transfer head, the pressing force tends to be lower at the center than at both side portions in the width direction. In addition, out of the pressing edge portion of the transfer head, stiffness tends to increase in both side portions in which tape guides that guide the transferable tape are arranged. For this reason, a so-called center dropout problem occurs.

Therefore, in the related art, the pressing edge portion strongly abuts onto the transfer target surface by elastically deforming the pressing edge portion while pressing the transfer head to the transfer target with a strong force in order to uniformize the pressing force.

A transfer head has been developed, in which a pressing edge piece to the transferable tape is provided in a leading end of an elastically deformable main body piece by installing a base portion in the casing, a counterpart guide piece is continuously connected to the rear end of the pressing edge piece by interposing the transferable tape, and a slit of the rear end opening is provided between the guide piece and the main body piece.

However, in order to provide an elastically deformable main body piece, it is necessary to thin the main body piece, which reduces the strength. In addition, it is necessary to further provide a transfer load for elastic deformation as well as a force for pressing the pressing edge piece to the transfer target object. This generates a problem in convenience.

Meanwhile, a coating film transfer tool has been developed, in which the transfer head is pivotable about the casing or the like, so that the coating film can be transferred with a weaker force. If the transfer head is pivotable, the transfer head can be pivoted just by pressing the transfer head to the transfer target surface with a slight force, so that the pressing edge portion is arranged in parallel with the transfer target surface.

However, in the coating film transfer tool in which the coating film can be transferred with a weak force, it is not necessary to press the transfer head to the transfer target with a strong force. Therefore, a state in which the coating film is not transferred is easily generated in the center.

SUMMARY

One or more embodiments of the present invention relates to a coating film transfer tool for transferring a corrective or adhesive transferable tape.

In one or more embodiments, an object of the present invention is to provide a convenient coating film transfer tool by preventing a state in which the coating film is not transferred in the center of the coating film in the pressing edge portion of the transfer head.

In order to address the aforementioned problems, one or more embodiments of the present invention may provide one or more of the following features of a coating film transfer tool.

In one or more embodiments of the present invention, a coating film transfer tool may include: a casing that houses a feeding reel around which a transferable tape before transferring a coating film is wound and a winding reel that winds the transferable tape after transferring the coating film; and a transfer head having a main body portion arranged in a front side which is one side of a front-rear direction of the casing to extend in a left-right direction perpendicular to the front-rear direction in a front end portion and provided with a pressing edge portion for transferring the coating film to a transfer target surface, in which the casing or a base member housed in the casing has a protruding tip that extends to the transfer head side and is connected to the transfer head, and the protruding tip presses a part of an area including a center of the left-right direction of the main body portion to the transfer target surface side in the event of a transfer.

In one or more embodiments of the present invention, in the coating film transfer tool described above, a hole portion may extend from a rear side to a front side of the longitudinal direction and be provided in a part of the area including the center of the left-right direction of the main body portion, and the protruding tip be inserted into the hole portion.

In one or more embodiments of the present invention, the transfer head may be pivotable about the protruding tip.

In one or more embodiments of the present invention, a front end of the protruding tip may extend to at least the vicinity of the pressing edge portion.

In one or more embodiments of the present invention, a distance between the front end of the pressing edge portion of the transfer head and the front end of the protruding tip may be set to 0.3 mm to 8 mm, and may sometimes be set to 0.5 mm to 4 mm.

In one or more embodiments of the present invention, an extending direction of the pressing edge portion may be perpendicular to rotation shafts of the feeding reel and the winding reel.

In one or more embodiments of the present invention, the transfer head may have a pair of tape guides arranged in left and right sides of the main body portion, each of the pair of tape guides may have a lower tape guide arranged in a side where the transferable tape before transferring the coating film passes in the main body portion and an upper tape guide arranged in a side where the transferable tape after transferring the coating film passes in the main body portion, and a gap between the pair of the upper tape guides be wider than a narrowest gap between the pair of the lower tape guides.

According to one or more embodiments of the present invention, it may be possible to provide a convenient coating film transfer tool capable of preventing a state in which the coating film is not transferred in the center of the coating film in the pressing edge portion of the transfer edge.

DETAILED DESCRIPTION

Figure 1:
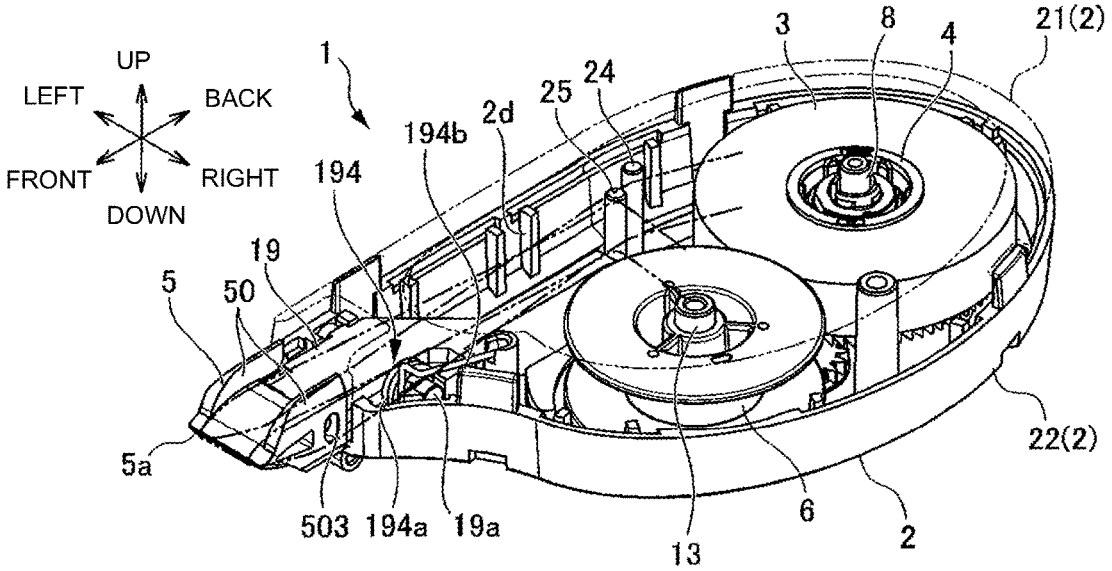
FIG. 1 is a top perspective view illustrating a coating film transfer tool according to an embodiment of the invention.
Figure 2:
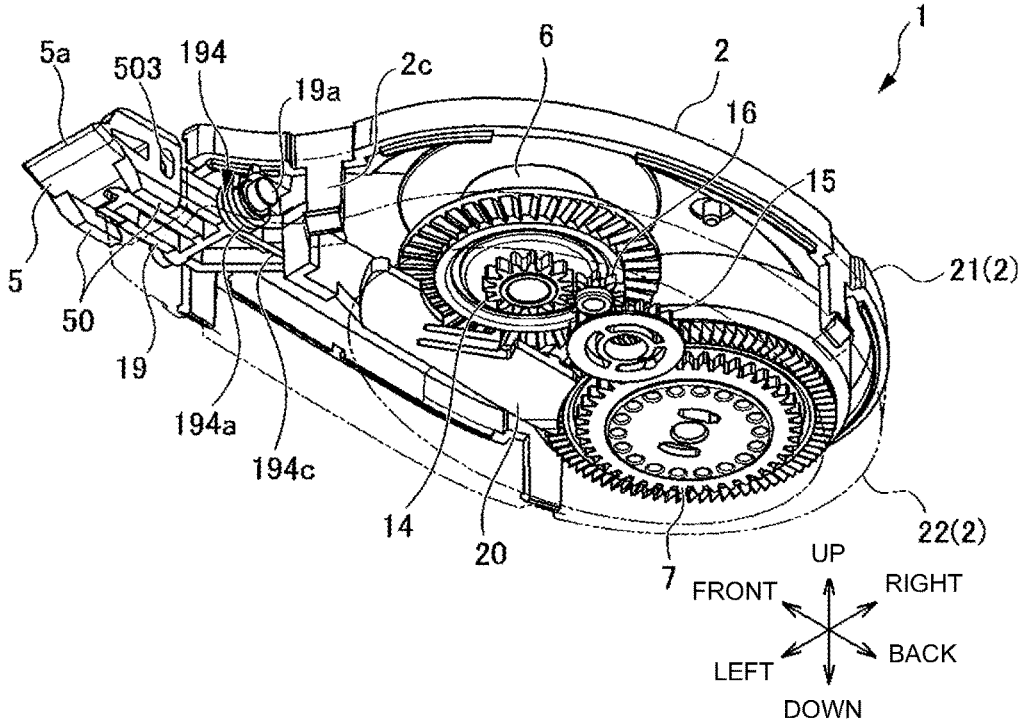
FIG. 2 is a bottom perspective view illustrating the coating film transfer tool of FIG. 1.

One or more embodiments of the invention will now be described. FIGS. 1-2 are perspective views illustrating a coating film transfer tool 1 according to an embodiment of the invention FIG. 1 is a top perspective view, and FIG. 2 is a bottom perspective view.

Figure 3:
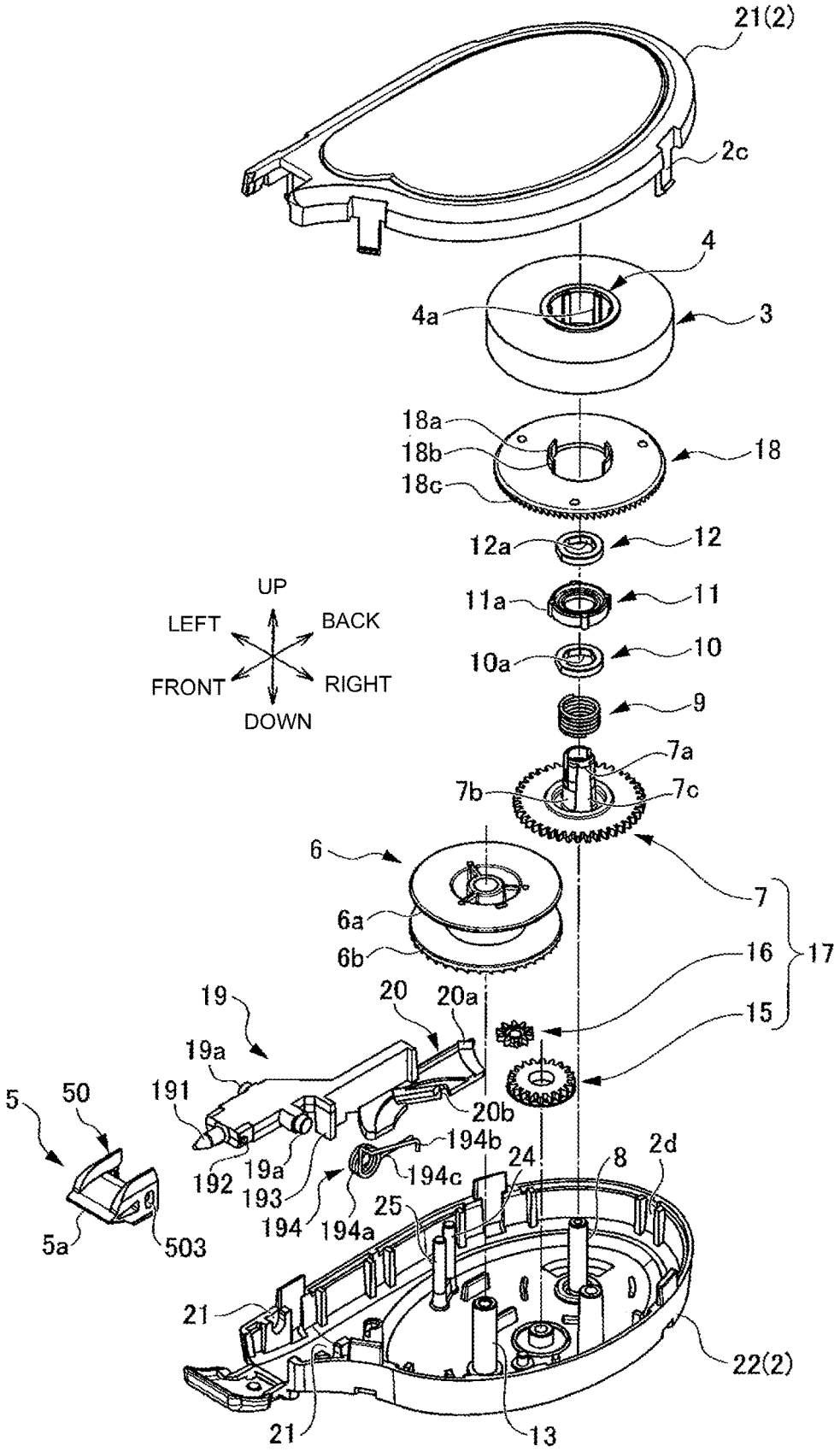
FIG. 3 is an exploded top perspective view illustrating the coating film transfer tool of FIGS. 1-2.

FIG. 3 is an exploded top perspective view illustrating the coating film transfer tool 1 of FIGS. 1-2.

Figure 4:
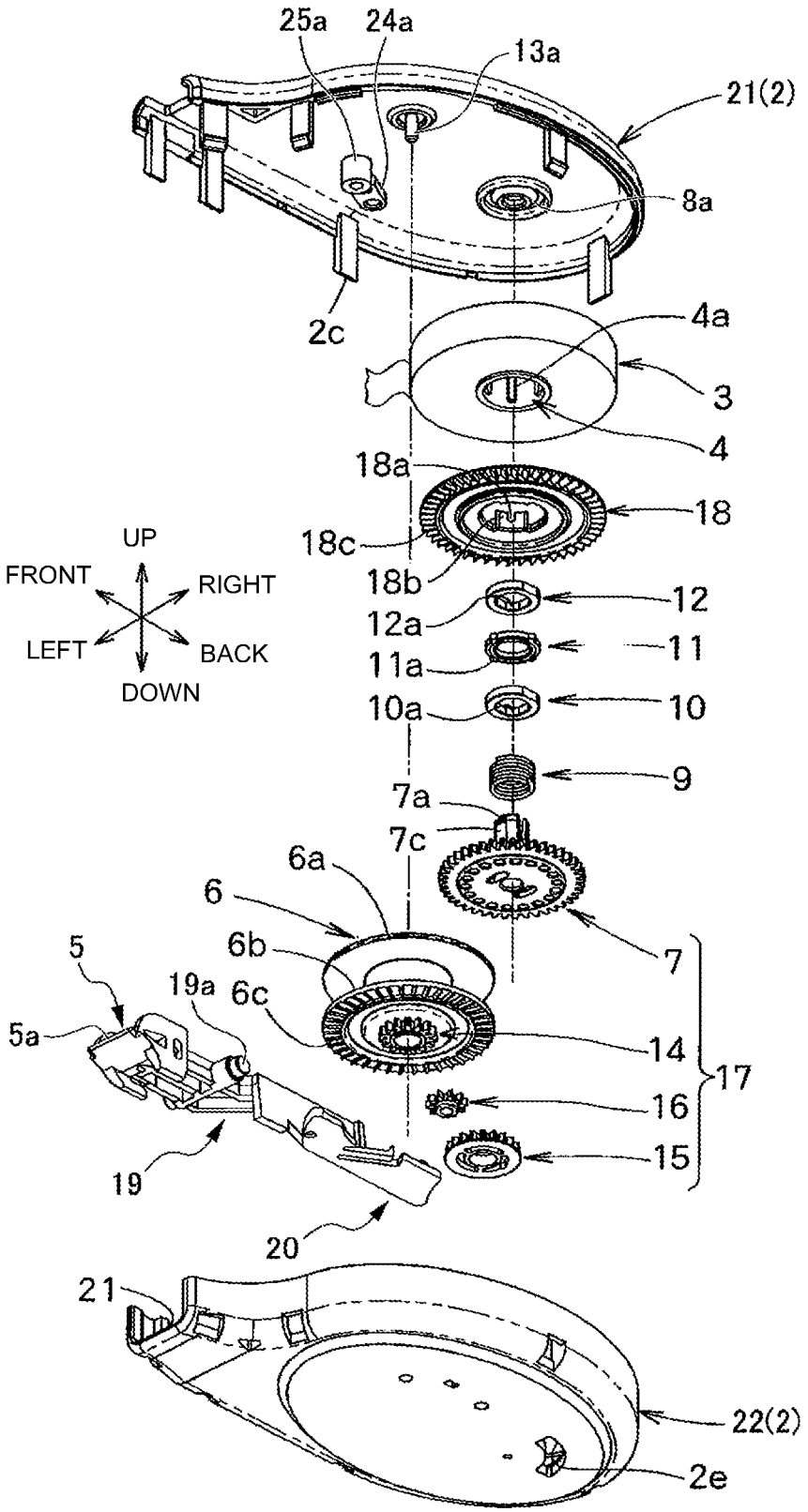
FIG. 4 is an exploded bottom perspective view illustrating the coating film transfer tool of FIGS. 1-2.

FIG. 4 is an exploded bottom perspective view illustrating the coating film transfer tool 1 of FIGS. 1-2. Note that a transferable tape 3 pressed to a transfer target surface in a transfer head 5 is not illustrated intentionally in several drawings.

Herein, a direction of transferring a coating film in a longitudinal direction of a casing 2 of the coating film transfer tool 1 will be referred to as a "front" direction, and its reverse direction will be referred to as a "rear" direction. In addition, a direction perpendicular to the longitudinal direction (front-rear direction) and a side where the transferable tape 3 before transferring the coating film passes in the transfer head 5 described below will be referred to as a "lower" side, and a side where the transferable tape 3 after transferring the coating film passes will be referred to as an "upper" side. Furthermore, a direction perpendicular to the front-rear direction and the up-down direction will be referred to as a left-right direction.

The coating film transfer tool 1 according to this embodiment is a so-called horizontal pulling type. The coating film transfer tool 1 has the casing 2 including a pair of casing members including upper and lower casing members 21 and 22.

The casing 2 houses (between the upper casing member 21 and the lower casing member 22) a feeding reel 4 around which the transferable tape 3 is wound, a base member 19 installed with the transfer head 5 that transfers the transferable tape 3 extracted from the feeding reel 4 to a transfer target surface, a winding reel 6 that winds the transferable tape 3 subjected to the transfer, and a power transmission mechanism 17 operated to synchronize the feeding reel 4 and the winding reel 6.

As illustrated in FIG. 3, inside of the lower casing member 22, a feeding reel support shaft 8, a winding reel support shaft 13, a first guide pin 24 that guides the transferable tape 3 extracted from the feeding reel 4 to the transfer head 5, and a second guide pin 25 that guides the transferable tape 3 subjected to transfer from the transfer head 5 to the winding reel 6 are erected to extend toward the upper casing member 21.

Meanwhile, as illustrated in FIG. 4, a feeding reel support shaft receptacle 8*a* into which the feeding reel support shaft 8 is inwardly inserted, a winding reel support shaft receptacle 13*a* into which the winding reel support shaft 13 is outwardly inserted, a first guide pin receptacle 24*a* into which the first guide pin 24 is inwardly inserted, and a second guide pin receptacle 25*a* into which the second guide pin 25 is inwardly inserted are provided on the inner surface of the upper casing member 21.

Along the side portion of the upper casing member 21, a plurality of fitting assist pieces 2*c* are erected to extend toward the lower casing member 22. Along the side portion of the lower casing member 22, a plurality of fitting assist seat portions 2*d* where the plurality of fitting assist pieces 2*c* are fitted are provided.

As the fitting assist pieces 2*c* of the upper casing member 21 are fitted to the fitting assist seat portions 2*d* of the lower casing member 22, a pair of upper and lower casing members 21 and 22 are assembled with each other to form the casing 2.

The feeding reel support shaft 8 provided in the lower casing member 22 is inwardly inserted into the feeding reel support shaft receptacle 8*a* while a feeding reel gear 7 and the feeding reel 4 are outwardly inserted rotatably.

The feeding reel gear 7 has a tubular rotation shaft 7*b* provided with a locking portion 7*a* in its end. A compression spring 9, an annular first spacer 10, an annular elastic stopper 11, and an annular second spacer 12 are sequentially inserted into the rotation shaft 7*b* and are retained by the locking portion 7*a*.

A locking protrusion 11*a* is provided on an outer circumferential surface of the elastic stopper 11. Meanwhile, a rib-shaped locking target portion 4*a* where the locking protrusion 11*a* is locked is provided on the inner circumferential surface of the feeding reel 4. As the locking protrusion 11*a* is locked to the rib-shaped locking target portion 4*a*, the elastic stopper 11 and the feeding reel 4 are rotated in synchronization.

An outer circumferential surface of the upper half of the rotation shaft 7*b* of the feeding reel gear 7 is cut out at nearly equal intervals to form four plane portions 7*c*. Meanwhile, the corner portions of inner holes 10*a* and 12*a* of the first and second spacers 10 and 12 are formed in an arc-like quadrilateral shape as seen in a plan view.

The plane portion 7*c* of the rotation shaft 7*b* adjoins with the sides of the quadrangles of the inner holes 10*a* and 12*a* of the first and second spacers 10 and 12, so that the first and second spacers 10 and 12 are irrotationally fitted to the rotation shaft 7*b* of the feeding reel gear 7. As a result, the feeding reel gear 7, the compression spring 9, the first spacer 10, and the second spacer 12 are rotated in synchronization.

The winding reel 6 is outwardly inserted into the winding reel support shaft 13 erected on the inner surface of the lower casing member 22. As illustrated in FIG. 4, a winding reel gear 14 is provided on the lower side surface of the winding reel 6. A first smaller gear 15 and a second smaller gear 16 are provided between the feeding reel gear 7 and the winding reel gear 14.

The feeding reel gear 7 meshes with the first smaller gear 15. The first smaller gear 15 meshes with the second smaller gear 16. The second smaller gear 16 meshes with the winding reel gear 14.

As the transferable tape 3 wound around the feeding reel 4 is extracted by performing a transfer work of the coating film, the rotation force of the feeding reel 4 is transmitted to the elastic stopper 11, and is transmitted to the feeding reel gear 7 by virtue of frictional forces generated between the side surface of the elastic stopper 11 and the side surface of the second spacer 12, between the side surface of the elastic stopper 11 and the side surface of the first spacer 10, and between the side surface of a flange 18 rotating in synchronization with the feeding reel 4 as described below and the side surface of the feeding reel gear 7.

As the feeding reel gear 7 is rotated, the rotation force is transmitted to the winding reel 6 through the power transmission mechanism 17 including the feeding reel gear 7, the first smaller gear 15, the second smaller gear 16, and the winding reel gear 14.

The flange 18 for controlling rotation of the feeding reel 4 during a non-use state and a use state of the coating film transfer tool 1 is integrally provided in the feeding reel 4. A locking target teeth 18*c* described below are provided in the peripheral edge of the flange 18 (refer to FIG. 4).

Figure 5:
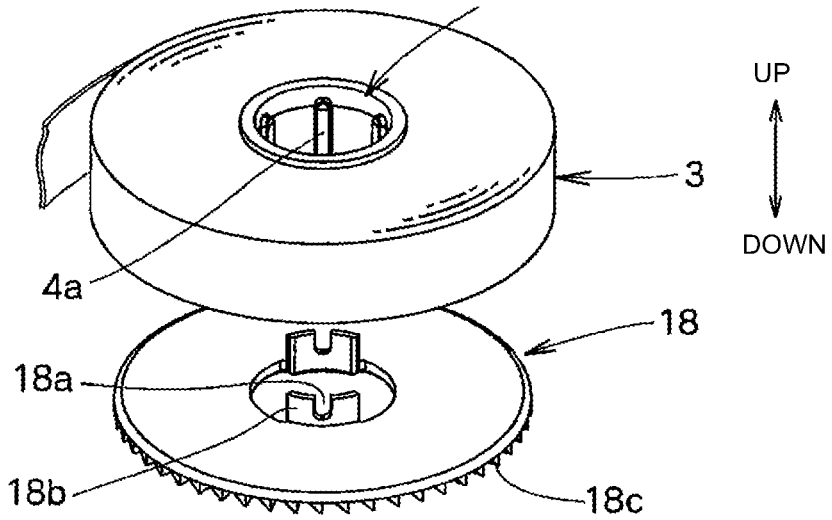
FIG. 5 is a top perspective view illustrating an embodiment of a state in which a flange is assembled with a feeding reel, illustrating a pre-assembly state.
Figure 6:
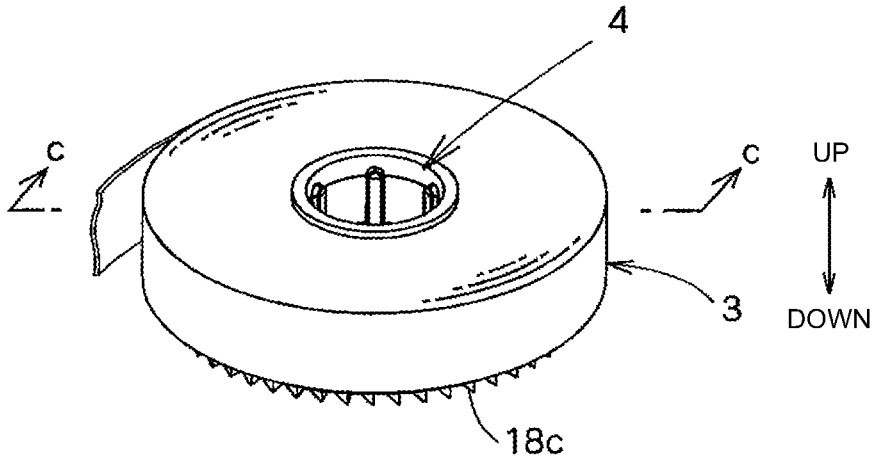
FIG. 6 is a top perspective view of the embodiment of FIG. 5, illustrating an assembled state.
Figure 7:
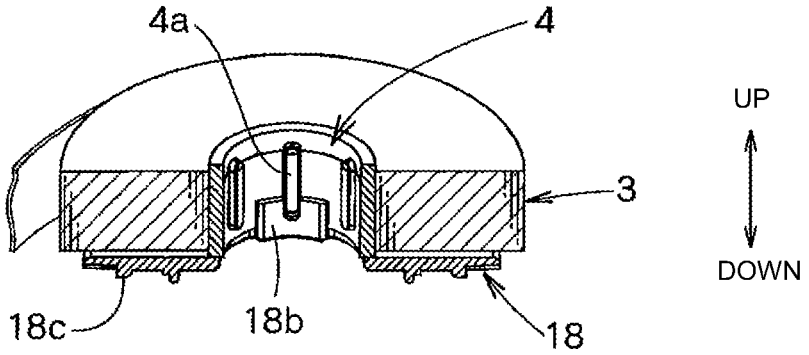
FIG. 7 is a cross-sectional perspective view of the embodiment of FIG. 6, taken along a line c-c of FIG. 6.

FIGS. 5-7 illustrate a state in which the flange 18 is assembled with the feeding reel 4. FIG. 5 is a top perspective view illustrating a pre-assembly state, FIG. 6 is a top perspective view illustrating an assembled state, and FIG. 7 is a cross-sectional perspective view taken along a line c-c of FIG. 6. Installation pieces 18*b* having notches 18*a* are provided on the upper surface of the flange 18. As the rib-like locking target portion 4*a* of the feeding reel 4 is locked to the notches 18*a* of the installation pieces 18*b*, the feeding reel 4 and the flange 18 are assembled so as to rotate in synchronization.

Returning to FIG. 4 from FIGS. 1-2, the coating film transfer tool 1 has the base member 19 and the transfer head 5 formed separately from the base member 19.

Figure 8:
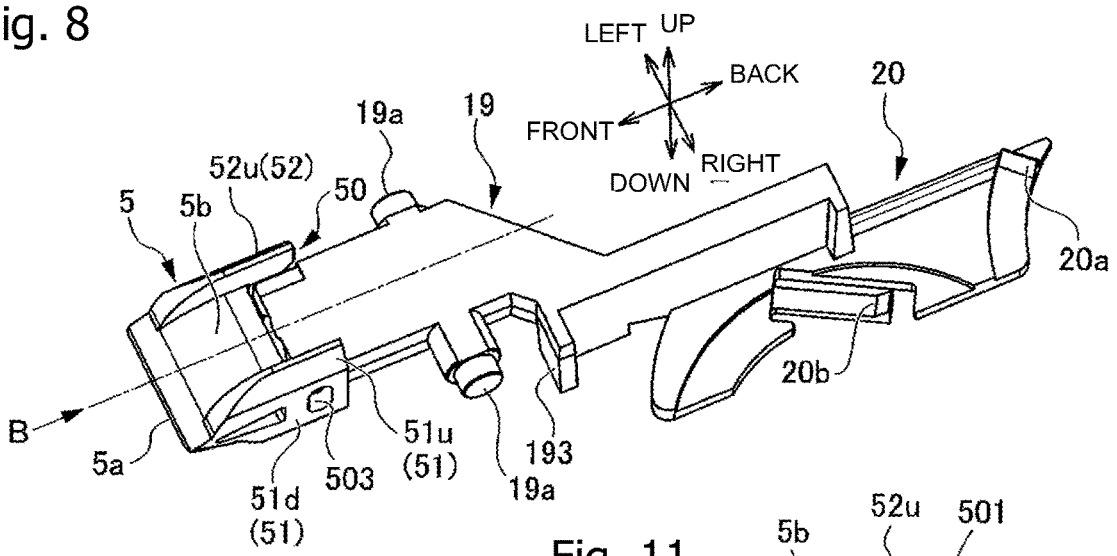
FIG. 8 is a perspective view illustrating an embodiment where a base member has a transfer head installed in a front end and a rotation restricting member provided in a rear half portion.
Figure 11:
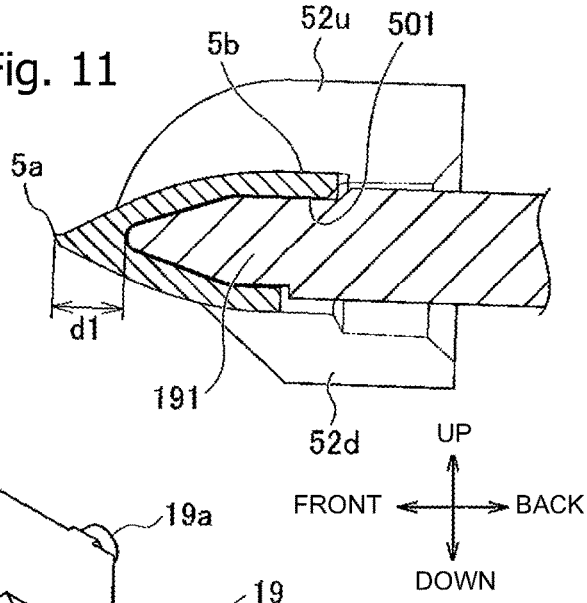
FIG. 11 is a cross-sectional view of the embodiment of FIG. 8.
Figure 9:
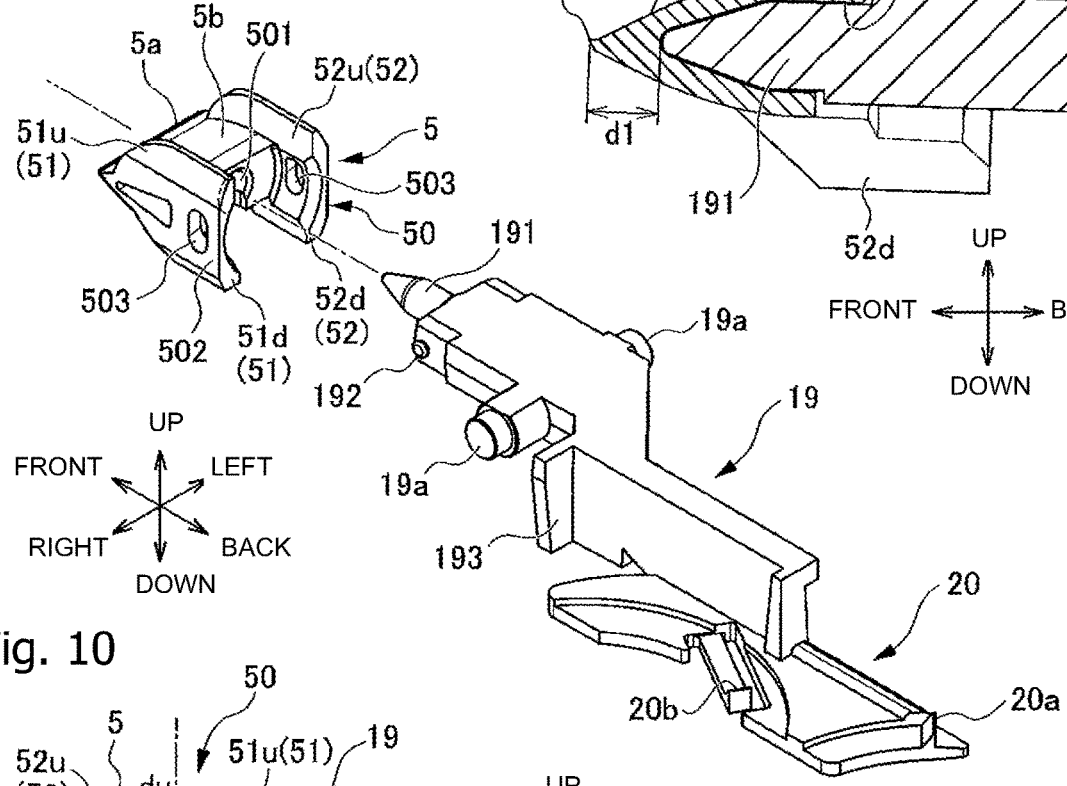
FIG. 9 is an exploded perspective view of the embodiment of FIG. 8.
Figure 10:
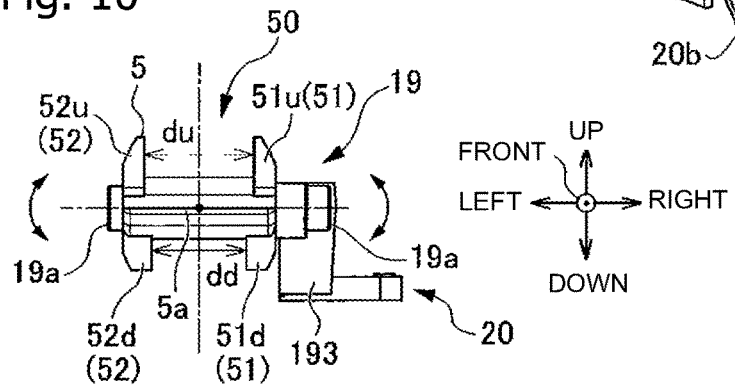
FIG. 10 is an arrow view of the embodiment of FIG. 8, as seen from an arrow B of FIG. 8.

FIGS. 8-11 illustrate the base member 19 having the transfer head 5 installed in a front end and a rotation restricting member 20 provided in a rear half portion. FIG. 8 is a perspective view, FIG. 9 is an exploded perspective view, FIG. 10 is an arrow view as seen from an arrow B of FIG. 8, and FIG. 11 is a cross-sectional view.

As illustrated in FIG. 9, a protruding tip 191 protruding to the front side is provided in the leading end of the base member 19. In addition, a pair of protrusions 192 protruding perpendicularly to the extending direction of the protruding tip 191 (in the left-right direction) are formed on each of the side surfaces of the leading end of the base member 19.

As illustrated in FIG. 11, the transfer head 5 has a main body portion 5*b* having a pressing edge portion 5*a* formed in an approximately triangular shape on a cross section taken along the longitudinal direction and provided in the front end. The pressing edge portion 5*a* extends in the left-right direction perpendicular to the longitudinal direction in a portion where the coating film is transferred to the transfer target object.

A hole portion 501 extending to the front side from the rear side of the longitudinal direction is provided in the center of the left-right direction on the rear end surface of the main body portion 5*b*. The protruding tip 191 is inserted into the hole portion 501. As a result, the transfer head 5 and the base member 19 are connected to each other.

The front end of the hole portion 501 is placed in the vicinity of the pressing edge portion 5*a*. As the protruding tip 191 is inserted into the hole portion 501, the front end of the protruding tip 191 is inserted at least to the vicinity of the pressing edge portion 5*a*. Specifically, a distance dl between the front end of the pressing edge portion 5*a* of the transfer head 5 and the front end of the protruding tip 191 when the protruding tip 191 is inserted into the hole portion 501 may be set to 0.3 mm to 8 mm, and may be set to 0.5 mm to 4 mm. By arranging the front end of the protruding tip 191 in this manner, it is possible to reliably transmit the pressing force to the pressing edge portion 5*a* when the transfer head 5 is pressed by the protruding tip 191.

When the coating film is transferred to a transfer target surface S1 (illustrated in FIGS. 13-15 as described below), an oblique downward force is applied to the casing 2 such that the lower surface of the pressing edge portion 5*a* of the transfer head 5 (the side where the transferable tape 3 passes before transferring the coating film) is pressed to the transfer target surface S1. Then, the protruding tip 191 presses the lower surface of the hole portion 501 downward, so that a predetermined range of the area including the center of the left-right direction of the main body portion 5*b* (a part of the area instead of the entire area of the left-right direction) is pressed.

In this case, the main body portion 5*b* is pivotable about the protruding tip 191. Therefore, the pressing edge portion 5*a* becomes in parallel with the transfer target surface S1. In this state, while nipping the transferable tape 3 therebetween, the pressing edge portion 5*a* is pressed to the transfer target surface S1 and moves on the contact target surface S1. Then, the coating film held by the transferable tape 3 is transferred to the transfer target surface S1.

Note that the main body portion 5*b* including the pressing edge portion 5*a* in the transfer head 5 may be formed of a material having slight elasticity. If the pressing edge portion 5*a* has slight elasticity, adherence between the pressing edge portion 5*a* and the transfer target surface S1 is improved so as to provide an excellent transfer feeling.

The transfer head 5 has a pair of tape guides 50 extending from the left and right side portions of the main body portion 5*b* to the rear side over the rear end surface of the main body portion 5*b*.

Long holes 503 extending in the vertical direction (perpendicularly to the transfer surface of the transfer head 5) are formed in a pair of tape guides 50 backward of the main body portion 5*b*. The pair of tape guides 50 also cover the leading end side of the base member 19 while the protruding tip 191 of the base member 19 is inserted into the hole portion 501.

The protrusions 192 of the base member 19 are inserted into the long holes 503. As a result, the transfer head 5 is connected to the base member 19.

Here, the vertical length of the long hole 503 is set to be longer than the diameter of the protrusion 192. As a result, as illustrated in FIG. 10, the transfer head 5 connected to the leading end of the base member 19 becomes pivotable about the protruding tip 191 inserted into the hole portion 501. In addition, the transfer head 5 becomes pivotable within a range that the protrusion 192 can move inside the long hole 503. That is, the vertical length of the long hole 503 determines a pivotable range of the transfer head 5. In other words, the long hole 503 restricts the pivotable range of the transfer head 5.

By pivoting the transfer head 5, the pressing edge portion 5*a* of the transfer head 5 can be easily arranged in parallel with the transfer target surface. Therefore, it is not necessary for a user to elastically deform the pressing edge portion 5*a* by strongly pressing the transfer head 5 in order to arrange the pressing edge portion 5*a* of the transfer head 5 in parallel with the transfer target surface. Therefore, it is possible to uniformly transfer the coating film with a small transfer load.

Figure 12:
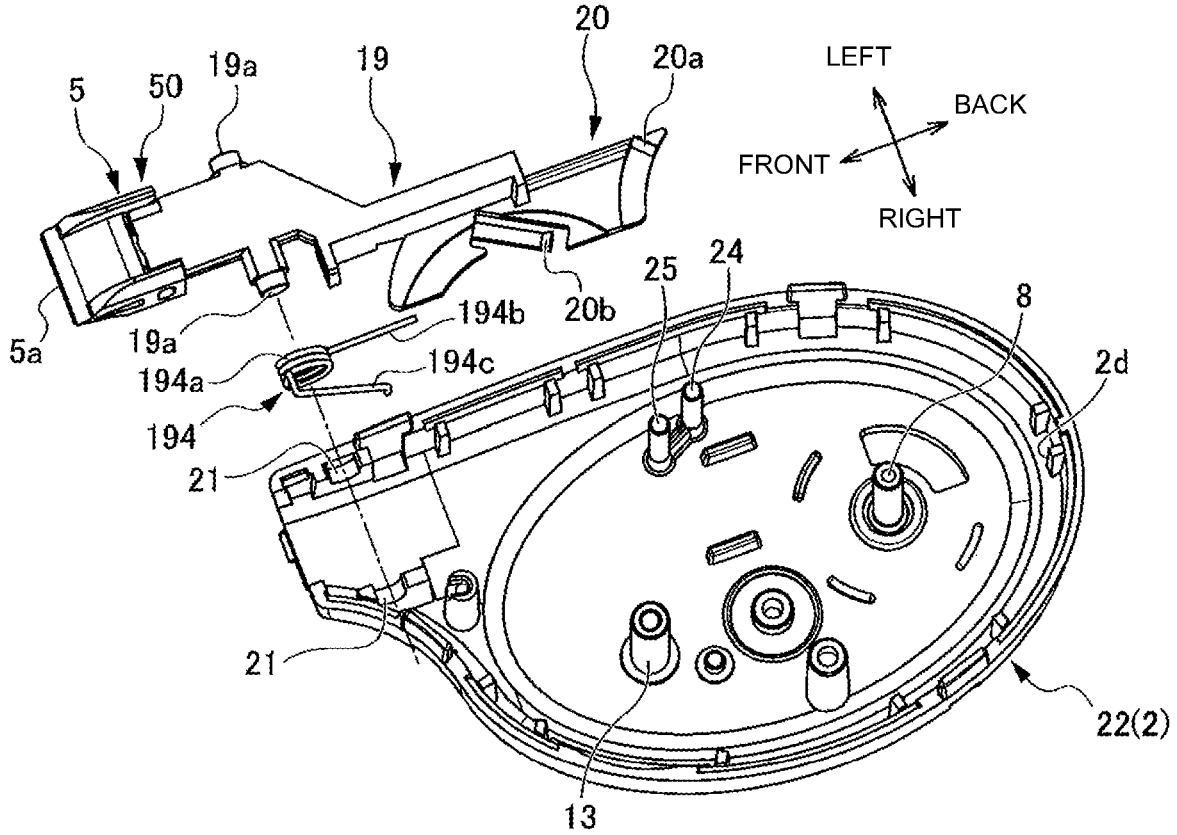
FIG. 12 is an exploded perspective view illustrating an embodiment where a base member is installed with a transfer head, a helical torsion spring, and a lower casing member.

FIG. 12 is an exploded perspective view illustrating the base member 19 installed with the transfer head 5, a helical torsion spring 194, and the lower casing member 22.

The base member 19 is biased such that the rotation restricting member 20 inhibits rotation of the feeding reel 4 with the helical torsion spring 194.

The helical torsion spring 194 has a coil portion 194*a*, a first spring portion 194*b* extending from one end of the coil portion 194*a*, and a second spring portion 194*c* extending from the other end of the coil portion 194*a*. In addition, the helical torsion spring 194 biases the base member 19 so as to inhibit rotation of the feeding reel 4 by outwardly fitting the coil portion 194*a* to a support shaft 19*a* of the base member 19, fixing the first spring portion 194*b* to the lower surface side of the base member 19, and fixing the second spring portion 194*c* to the inner surface of the underlying lower casing member 22.

A winding reel locking hook 20*b* is formed integrally with the base member 19 in an arm shape and has elasticity.

Figure 13:
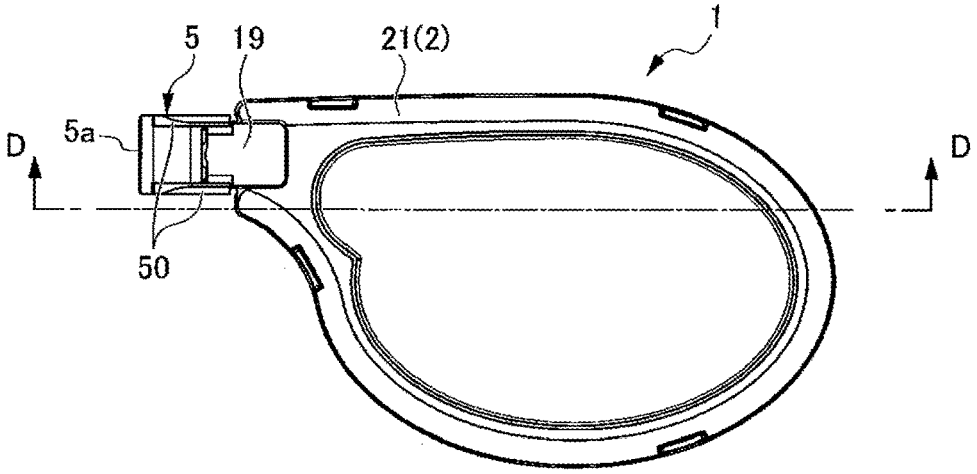
FIG. 13 is a plan view illustrating a horizontal pulling type coating film transfer tool.
Figure 14:
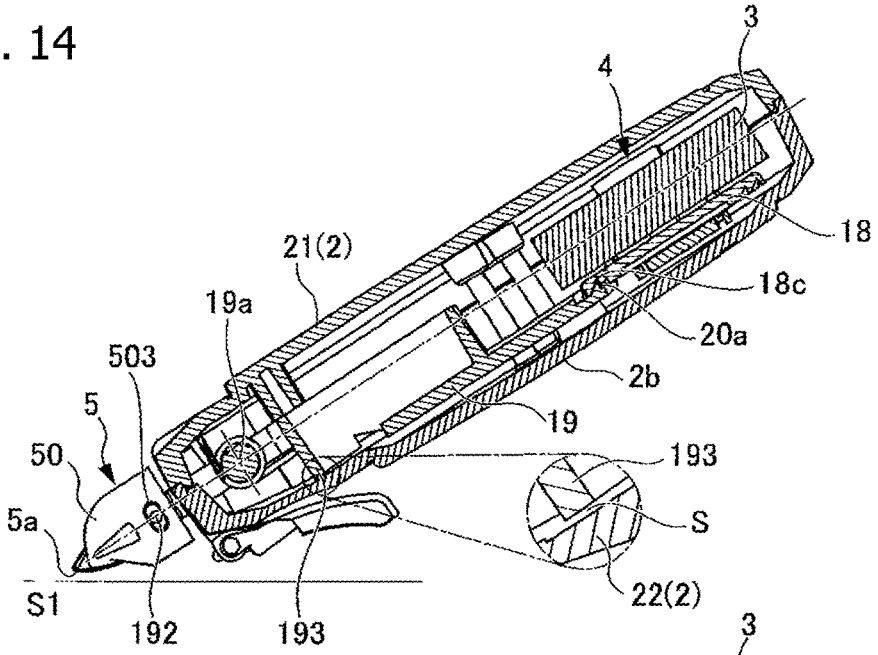
FIG. 14 is a cross-sectional view of the coating film transfer tool of FIG. 13, taken along a line D-D of FIG. 13 to illustrate a state of a base body in a non-use state.
Figure 15:
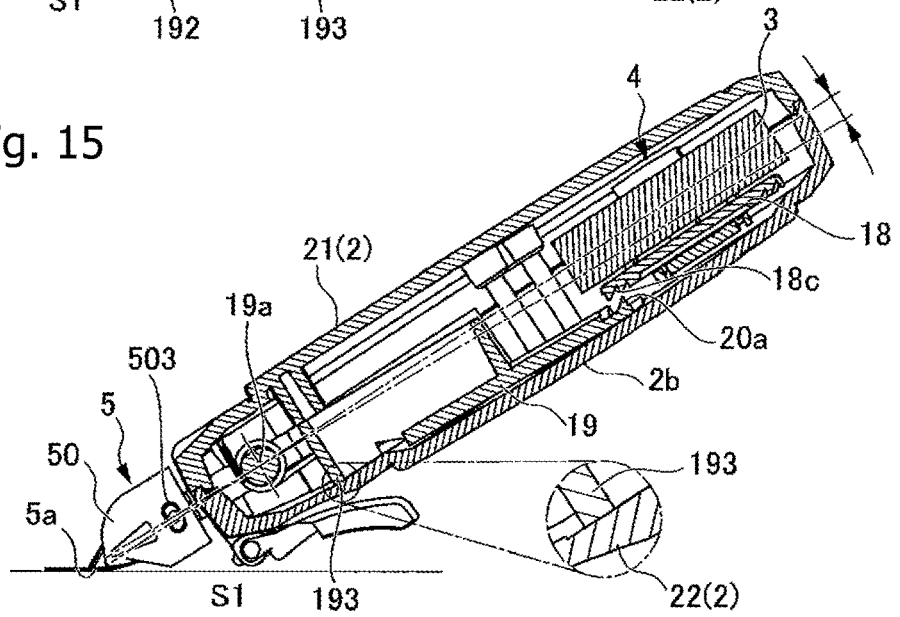
FIG. 15 is a cross-sectional view of the coating film transfer tool of FIG. 13, taken along the line D-D of FIG. 13 to illustrate a state of a base body in a use state.

FIGS. 13-15 illustrate a state of a base body in a use state and in a non-use state. FIG. 13 is a plan view illustrating the coating film transfer tool, FIG. 14 is a cross-sectional view taken along a line D-D of FIG. 13 to illustrate a non-use state, and FIG. 15 is a cross-sectional view taken along a line D-D of FIG. 13 to illustrate a use state.

The coating film transfer tool 1 has a restricting portion 193 that restricts the base member 19 from further pivoting from a position in which inhibition of rotation of the feeding reel 4 using the rotation restricting member 20 is released while the transfer head 5 is pressed to the transfer target surface S1 during a use state.

As illustrated in FIGS. 14 and 15, the restricting portion 193 is formed integrally with the base member 19 and is arranged to protrude downward from the lower surface of the base member 19. More specifically, the restricting portion 193 is arranged in the vicinity of the support shaft 19*a* of the base member 19 backward of the support shaft 19*a*.

Using the coating film transfer tool 1 having the aforementioned restricting portion 193, the base member 19 is biased such that the rear end side is raised upward higher than the support shaft 19*a* by the helical torsion spring 194 during a non-use state as illustrated in FIG. 14, and a feeding reel locking hook 20*a* of the rotation restricting member 20 is engaged with the locking target teeth 18*c* of the flange 18 rotating in synchronization with the feeding reel 4.

As a result, rotation of the feeding reel 4 is inhibited. In addition, in this state, a predetermined gap S is formed between the restricting portion 193 and the inner surface of the underlying lower casing member 22.

Meanwhile, during a use state (transfer) of the coating film transfer tool 1, the transfer head 5 is pressed to the transfer target surface S1 as illustrated in FIG. 15. Therefore, the base member 19 is pivoted about the support shaft 19*a* such that the transfer head 5 moves upward resisting to the biasing force of the helical torsion spring 194. Then, the rotation restricting member 20 arranged oppositely to the transfer head 5 with respect to the support shaft 19*a* moves downward, so that the feeding reel locking hook 20*a* engaged with the locking target teeth 18*c* during a non-use state is disengaged from the locking target teeth 18*c*, and rotation inhibition of the feeding reel 4 is released.

While the base member 19 pivots to a position in which inhibition of rotation of the feeding reel 4 by the rotation restricting member 20 is released, the restricting portion 193 comes into contact with the inner surface of the lower casing member 22, so that further pivoting of the base member 19 is restricted.

Note that the winding reel locking hook 20*b* is formed in an arm shape and has elasticity as described above. As a result, even when locking between the feeding reel locking hook 20*a* and the locking target teeth 18*c* of the flange 18 of the feeding reel 4 is not released in order to prevent loosening during a non-use state, the winding reel locking hook 20*b* is elastically deformed so that the winding reel 6 can be rotated in a winding direction.

Returning to FIGS. 8-11, as described above, the transfer head 5 has the pair of tape guides 50 in the left and right sides of the main body portion 5*b*. The pair of tape guides 50 include a right tape guide 51 and a left tape guide 52 arranged in parallel with each other.

The right and left tape guides 51 and 52 have upper tape guides 51*u* and 52*u*, respectively, positioned in an upper part of the main body portion 5*b* and lower tape guides 51*d* and 52*d*, respectively, positioned in a lower part of the main body portion 5*b*.

As illustrated in FIG. 10, a gap dd between the pair of lower tape guides 51*d* and 52*d* provided in the left and right sides is set to, for example, −0.03 mm to +0.3 mm with respect to the width of the transferable tape 3.

As illustrated in FIG. 11 and the like, the front ends of the lower tape guides 51*d* and 52*d* (only 52*d* is illustrated) are positioned in rear of the front ends of the upper tape guides

51*u* and 52*u* (only 52*u* is illustrated), and are separated from the leading end of the pressing edge portion 5*a* by a predetermined distance.

The front sides of the lower tape guides 51*d* and 52*d* are obliquely inclined so as to descend backward from the front end.

In this manner, the front ends of the lower tape guides 51*d* and 52*d* are separated from the pressing edge portion 5*a* by a predetermined distance, and the front sides of the lower tape guides 51*d* and 52*d* are obliquely formed. Therefore, the lower tape guides 51*d* and 52*d* do not hinder contact between the pressing edge portion 5*a* and the transfer target surface S1 and a transfer of the transferable tape.

A gap du between the front ends of the pair of upper tape guides 51*u* and 52*u* provided in the left and right sides is wider than the gap dd between the lower tape guides 51*d* and 52*d*. For example, the gap du may be set to 0.5 mm or larger with respect to the width of the tape, and may be set to 1 mm or larger and 3 mm or smaller with respect to the width of the tape.

The front ends of the upper tape guides 51*u* and 52*u* are placed in the vicinity of the pressing edge portion 5*a* in front of the lower tape guides 51*d* and 52*d*. The front sides of the upper tape guides 51*u* and 52*u* have an arc shape curved rearward from the front end to the upper side, so that the upper tape guides 51*u* and 52*u* have a fan shape.

According to the present invention, the front ends of the upper tape guides 51*u* and 52*u* are placed slightly in rear of the front end of the pressing edge portion 5*a* (that is, not far from the pressing edge portion 5*a*).

Here, the front ends of the upper tape guides 51*u* and 52*u* are portions of the upper tape guides 51*u* and 52*u* placed frontmost in the tape path.

Note that the gap du between the front ends of the upper tape guides 51*u* and 52*u* is wider than the narrowest gap between the lower tape guides 51*d* and 52*d* in the tape path. In addition, the gap du between the front ends of the upper tape guides 51*u* and 52*u* may be wider than the widest gap between the lower tape guides 51*d* and 52*d* in the tape path.

The transferable tape 3 is manufactured, for example, by forming a release layer such as silicon resin on one or both surfaces of a long body formed of a plastic film such as polyethylene terephthalate, polypropylene, and polyethylene or paper with a thickness of 3 μm to 60 μm as a base material, and coating an adhesive or the like on one surface of the base material using a method known in the art.

The adhesive includes an acrylic resin-based adhesive, a vinyl resin-based adhesive, a rosin-based adhesive, a rubber-based adhesive, or a mixture obtained by mixing an agent such as a crosslinking agent, a tackifier, a plasticizer, an antioxidant, a filler, a thickener, a pH adjuster, and an antifoaming agent with such an adhesive as appropriate. Specifically, a tape having the adhesive layer provided on one surface of the base material is an adhesive tape (tape paste). A tape having an opaque layer formed of pigments having opacity and polymer resin as a binder or the like provided on one surface of the base material and an adhesive layer formed thereon is a corrective tape. A tape having a fluorescent coloring layer provided on one surface of the base material and an adhesive layer formed thereon is a fluorescent tape. The layer formed on one surface of the base material has a thickness of 0.3 μm to 60 μm, for example, after drying.

In general, the transferable tape 3 has a width of approximately 2 mm to 15 mm.

(1) According to this embodiment, the protruding tip 191 is formed in the leading end of the base member 19, and the hole portion 501 extending from the rear side to the front side of the longitudinal direction is formed on the rear end surface of the transfer head 5 as described above. As the protruding tip 191 is inserted into the hole portion 501, and a force is applied to the casing 2 in the event of a transfer such that the pressing edge portion 5*a* of the transfer head 5 presses the transfer target surface, the protruding tip 191 presses the inner surface of the hole portion 501 downward, so that a part of the area including the center of the left-right direction of the main body portion 5*b* is pressed.

Here, for example, as Comparative Example 1, if the entire area of the main body portion 5*b* is pressed instead of the partial area unlike this embodiment, the pressing force tends to be weakened in the center of the left-right direction of the pressing edge portion 5*a* relative to the left and right ends. This may easily generate a state in which the coating film is not transferred in the center of the coating film (so-called a center dropout).

However, according to this embodiment, the center of the pressing edge portion 5*a* is pressed, and the force is distributed from the center to the left and right directions. Therefore, a state in which the coating film is not transferred in the center of the coating film is not easily generated regardless of the transfer load. In addition, cracking of the transferred coating film or chipping of the coating film during writing does not easily occur.

(2) According to this embodiment, the transfer head 5 is pivotable about the protruding tip 191 inserted into the hole portion 501.

By virtue of pivoting of the transfer head 5, it is possible to easily arrange the pressing edge portion 5*a* of the transfer head 5 in parallel with the transfer target surface S1. Therefore, it is not necessary for a user to strongly press the transfer head 5 and elastically deform the pressing edge portion 5*a* in order to arrange the pressing edge portion 5*a* of the transfer head 5 in parallel with the transfer target surface S1. Accordingly, it is possible to uniformly transfer the coating film with a small transfer load.

(3) The main body portion 5*b* is pivotable about the protruding tip 191. Therefore, the pressing edge portion 5*a* can abut on the transfer target surface without twisting or deforming the protruding tip 191.

Therefore, it is not necessary to weaken the stiffness of the protruding tip 191 or thin the protruding tip 191. Accordingly, it is possible to increase a strength of the protruding tip 191 as a connecting portion between the casing 2 and the transfer head 5 and improve durability of the coating film transfer tool 1.

(4) Since the protruding tip 191 and the main body portion 5*b* are separate members, they can be manufactured using different materials. Therefore, it is possible to manufacture the main body portion 5*b* with a material having small elasticity unlike the protruding tip 191.

Since the main body portion 5*b* is manufactured of a material having elasticity, compared to the protruding tip 191, it is possible to further improve adherence between the main body portion 5*b* (pressing edge portion 5*a*) and the transfer target surface S1. Therefore, it is possible to improve a transfer feeling. Furthermore, it is possible to further prevent a state in which the coating film is not transferred in the center of the coating film.

(5) For example, as Comparative Example 2, a shaft of the main body portion may be lengthened to the rear side and may be connected to the casing or the base member. In this case, a structure for pivotally receiving the shaft is necessary in the casing or the base member. This accordingly increases the thickness of the casing.

However, the thinner casing is desirable in terms of storability. According to this embodiment, an axial support structure (the protruding tip 191 and the hole portion 501) is in the transfer head 5 side. Therefore, the casing 2 is not thickened. Note that, since the transfer head 5 side has space, the entire size of the coating film transfer tool 1 does not increase even when the structure for receiving the protruding tip 191 such as the hole portion 501 is provided.

(6) For example, similar to Comparative Example 2, if the shaft is lengthened from the main body portion to the rear side and is connected to the casing or the base member, the rotating transfer head becomes heavy, and the transfer head is lengthened in the longitudinal direction as a whole, relative to this embodiment. As a result, compared to this embodiment, pivoting of the transfer head to follow the shape of the transfer target surface becomes difficult.

However, according to this embodiment, the transfer head 5 is compact. Therefore, pivoting to follow the transfer target surface becomes easy.

(7) According to this embodiment, when the transferable tape 3 is continuously fed and passes through a gap between the lower tape guides 51*d* and 52*d* during a use state of the coating film transfer tool 1, a left-right deviation of the transferable tape 3 is restricted by the lower tape guides 51*d* and 52*d*.

Here, when the transfer head 5 is pivoted, the gap between the lower tape guides 51*d* and 52*d* is nearly equal to the width of the transferable tape 3. Therefore, the lower tape guides 51*d* and 52*d* may come into contact with the transferable tape 3, and the edge of the transferable tape 3 may be slightly twisted (flexed, deformed, or distorted).

However, even when the edge of the transferable tape 3 is slightly twisted, the transferable tape 3 is recovered to its original shape by virtue of a restoring force or a tensile force of the transferable tape 3 by further feeding the transferable tape 3 from the position coming into contact with the lower tape guides 51*d* and 52*d* to move forward.

(8) For example, if the transfer head 5 is pivoted and inclined when the transferable tape 3 passes through the pressing edge portion 5*a*, the upper tape guides 51*u* and 52*u* provided in the vicinity of the pressing edge portion 5*a* may come into contact with the edge of the transferable tape 3, so that the transferable tape 3 may be twisted.

If the transferable tape 3 is twisted in the vicinity of the pressing edge portion 5*a* in this manner, the transferable tape 3 may be transferred while the edge of the transferable tape 3 is bent in the pressing operation.

Then, a portion that does not come into contact with the transfer target surface is generated in the coating film. This portion is not transferred to the transfer target surface and may reduce the width of the coating film or generate a partial damage to the coating film.

However, according to this embodiment, the gap between the upper tape guides 51*u* and 52*u* arranged in the vicinity of the pressing edge portion 5*a* is wider than the gap between the lower tape guides 51*d* and 52*d*. Therefore, even when the transfer head 5 is inclined, a possibility of contact with the upper tape guides 51*u* and 52*u* is low.

Therefore, a possibility of reducing the width of the coating film or generating a partial damage decreases when the transferable tape 3 is transferred to the transfer target surface.

According to this embodiment, as the pressing force of the transfer head 5 to the transfer target surface is released after the transfer, the transfer head 5 is returned to a specified position by virtue of a restoring force or a tensile force of the transferable tape 3 (to a position where the transfer head 5 is not rotated or a direction in which the pressing edge portion 5*a* becomes perpendicular to the feeding direction of the transferable tape 3).

(9) In addition, the coating film transfer tool 1 according to the invention is the so-called horizontal pulling type coating film transfer tool 1 in which a direction of the pressing edge portion 5*a* placed in the front end of the transfer head 5 to press the transferable tape 3 to the transfer target surface is substantially perpendicular to the feeding reel support shaft 8 of the feeding reel 4 and the winding reel support shaft 13 of the winding reel 6. As a result, it is possible to provide the convenient coating film transfer tool 1.

Figure 16:
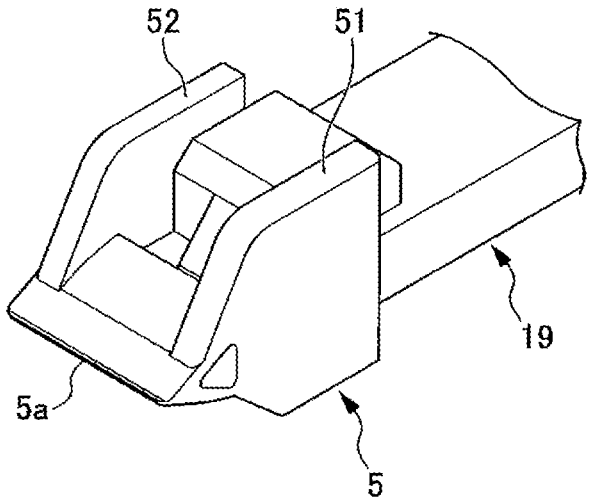
FIG. 16 is a perspective view of another embodiment, illustrating a transfer head and a part of the base member including a protruding tip.
Figure 17:
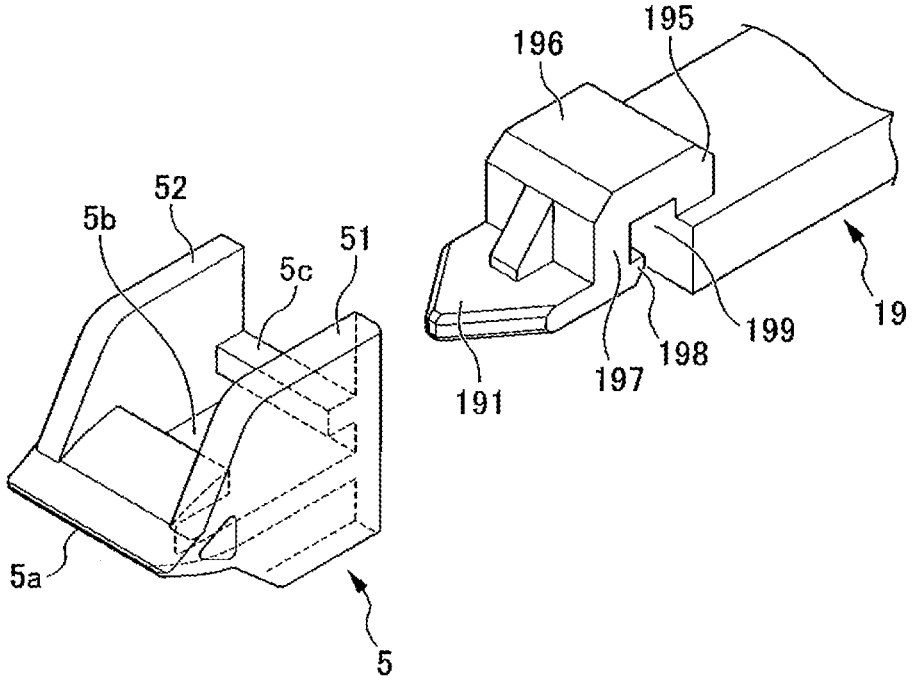
FIG. 17 is an exploded perspective view of the embodiment of FIG. 16, illustrating the transfer head and a part of the base member including the protruding tip.

FIGS. 16-17 illustrate another embodiment. FIG. 16 is a perspective view illustrating the transfer head 5 and a part of the base member 19 including the protruding tip 191, and FIG. 17 is an exploded perspective view illustrating the transfer head 5 and a part of the base member 19 including the protruding tip 191.

Figure 20:
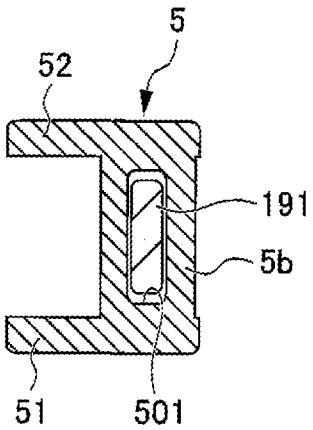
FIG. 20 is a cross-sectional view taken along a line AB-AB of FIG. 18.
Figure 18:
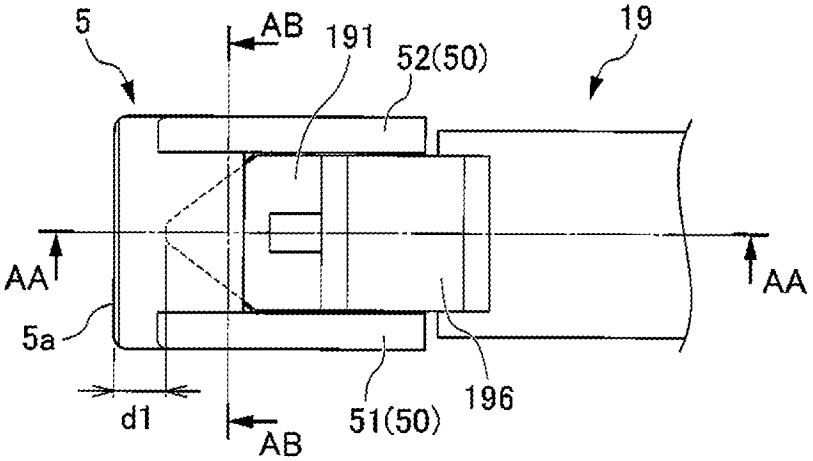
FIG. 18 is a top view of the another embodiment, illustrating the transfer head and a part of the base member including the protruding tip.
Figure 19:
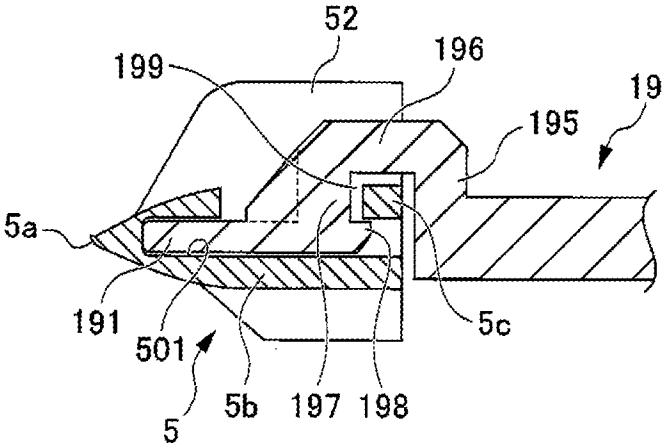
FIG. 19 is a cross-sectional view taken along a line AA-AA of FIG. 18.

FIGS. 18-20 illustrate the another embodiment. FIG. 18 is a top view illustrating the transfer head 5 and a part of the base member 19 including the protruding tip 191, FIG. 19 is a cross-sectional view taken along a line AA-AA of FIG. 18, and FIG. 20 is a cross-sectional view taken along a line AB-AB of FIG. 18.

The another embodiment is different from the first described embodiment in the structure of the connecting portion between the transfer head 5 and the base member 19. Like reference numerals denote like elements as in the first described embodiment, and they will not be described.

The base member 19 includes a first portion 195 formed by bulging a predetermined area including the center of the left-right direction of the front end by a predetermined height in the front end portion, a second portion 196 that is bent from the upper end of the first portion 195 and extends forward, a third portion 197 that is bent from the second portion 196 and extends downward, and the protruding tip 191 extending forward from the lower end of the third portion 197.

The protruding tip 191 is shaped to have an approximately uniform thickness in the vertical direction while a triangular horizontal cross-sectional portion is installed in a leading end of a rectangular horizontal cross-sectional portion.

A front end surface of the base member 19, a front surface of the first portion 195, a lower surface of the second portion 196, a rear surface of the third portion 197, and an upper surface of a fourth portion 198 that is placed in rear of the protruding tip 191 and protrudes slightly backward of the rear surface of the third portion 197 constitute an engagement portion 199 extending in the left-right direction in an approximately rectangular vertical cross-sectional shape. The engagement portion 199 is engaged with a crossbar portion 5*c* described below.

Meanwhile, the transfer head 5 includes the main body portion 5*b* and the pressing edge portion 5*a* that is provided in front of the main body portion 5*b* and has a rectangular parallelepiped horizontal cross section and an approximately triangular vertical cross section along the longitudinal direction.

The hole portion 501 extending from the rear surface to the front side is provided on the rear surface of the pressing edge portion 5*a* serving as a connecting side to the main body portion 5*b*. A horizontal cross section of the hole portion 501 has a triangular shape matching the triangular shape of the leading end of the protruding tip 191.

The vertical width of the hole portion 501 is approximately uniform to match the vertical width of the protruding tip 191 so as to receive the inserted protruding tip 191. The hole portion 501 has a horizontal bottom surface continuous to the upper surface of the main body portion 5*b* so as to allow the protruding tip 191 to be smoothly inserted.

The crossbar portion 5*c* bridged between the right and left tape guides 51 and 52 is provided over the rear end of the main body portion 5*b*. As the protruding tip 191 is inserted into the hole portion 501, the crossbar portion 5*c* is engaged with the engagement portion 199 described above, so that the transfer head 5 is installed in the base member 19.

In this case, the fourth portion 198 is pressed by the crossbar portion 5*c*. As a result, disengagement of the transfer head 5 from the base member 19 is prevented.

Note that, according to the another embodiment, similarly, the front end of the hole portion 501 may be placed in the vicinity of the pressing edge portion 5*a*. Specifically, the distance dl between the front end of the pressing edge portion 5*a* of the transfer head 5 and the front end of the protruding tip 191 may be set to 0.3 mm to 8 mm, and may be set to 0.5 mm to 4 mm when the protruding tip 191 is inserted into the hole portion 501. By arranging the front end of the protruding tip 191 in this manner, it is possible to reliably transmit the pressing force to the pressing edge portion 5*a* when the transfer head 5 is pressed by the protruding tip 191.

Unlike the first described embodiment, the transfer head 5 is not pivoted about the base member 19 according to the another embodiment. However, similar to the first described embodiment, as a force is applied to the casing 2 such that the pressing edge portion 5*a* of the transfer head 5 is pressed to the transfer target surface in the event of a transfer, the protruding tip 191 presses the inner surface of the hole portion 501 downward, so that a part of the area including the center of the left-right direction of the main body portion is pressed. As a result, a state in which the coating film is not transferred in the center of the coating film is not easily generated. In addition, cracking in the transferred coating film or chipping of the coating film during writing is not easily generated.

While embodiments according to the invention have been described hereinbefore, the invention is not limited thereto. For example, the shapes of the protruding tip and the hole portion are not limited to those of the embodiments. For example, they may have another pivotable configuration relationship in which the protruding tip has a circular columnar shape, and the hole portion has a shape matching the circular columnar shape. As a non-pivotable structure, the protruding tip may have a rectangular parallelepiped shape, a triangular prism shape, or the like.

One or more embodiments of the present invention may be to provide a convenient coating film transfer tool capable of preventing a state in which a coating film is not transferred in the center of the coating film in a pressing edge portion of a transfer head.

In one or more embodiments of the present invention, a coating film transfer tool 1 may include: a casing 2 that houses a feeding reel 4 around which a transferable tape 3 before transferring a coating film is wound and a winding reel 6 that winds the transferable tape 3 after transferring the coating film; and a transfer head 5 having a main body portion 5*b* arranged in a front side which is one side of a longitudinal direction of the casing 2 to extend in a left-right direction perpendicular to the longitudinal direction in a front end portion and provided with a pressing edge portion 5*a* for transferring the coating film to a transfer target surface. The casing 2 or a base member 19 housed in the casing 2 has a protruding tip 191 that extends to the transfer head 5 side. The protruding tip 191 presses a part of an area including a center of the left-right direction of the main body portion 5*b* to the transfer target surface side in the event of a transfer.

One or more of embodiments of the present invention may include one or more of the following features:

1 Coating film transfer tool
2 Casing
3 Transferable tape
4 Feeding reel
5 Transfer head
5*a* Pressing edge portion
5*b* Main body portion
5*c* Crossbar portion
6 Winding reel
19 Base member
21 Upper casing member
22 Lower casing member
50 Tape guide
51 Right tape guide
51*d* Lower tape guide
51*u* Upper tape guide
52 Left tape guide
52*d* Lower tape guide
52*u* Upper tape guide
191 Protruding tip
192 Protrusion
501 Hole portion The disclosure set forth above may encompass multiple distinct inventions with independent utility. Although each of these inventions has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only. The subject matter of this disclosure includes all novel and nonobvious combinations and subcombinations of the various elements, features, functions, and/or properties disclosed herein. The claim concepts particularly point out certain combinations and subcombinations regarded as novel and nonobvious. Other combinations and subcombinations of features, functions, elements, and/or properties may be claimed in applications claiming priority from this or a related application. Such claims, whether directed to a different example or to the same example, and whether broader, narrower, equal, or different in scope to the original claims, also are regarded as included within the subject matter of the present disclosure. Furthermore, explicit reference is hereby made to all embodiments and examples shown in the drawings, whether or not described further herein.

What is claimed is:

1. A coating film transfer tool comprising:

a casing that houses a feeding reel around which a transferable tape before transferring a coating film is wound and a winding reel that winds the transferable tape after transferring the coating film; and a transfer head having a main body portion arranged in a front side which is one side of a front-rear direction of the casing to extend in a left-right direction perpendicular to the front-rear direction in a front end portion and provided with a pressing edge portion adapted for transferring the coating film to a transfer target surface, wherein the casing or a base member housed in the casing has a protruding tip that extends to the transfer head side and is connected to the transfer head, and wherein the protruding tip is configured to press a central part of the main body portion toward the transfer target surface side in the event of a transfer.

2. The coating film transfer tool according to claim 1, wherein a hole portion extending from a rear side to a front side of the longitudinal direction is provided in the central part of the main body portion, and the protruding tip is inserted into the hole portion.

3. The coating film transfer tool according to claim 2, wherein the transfer head is pivotable about the protruding tip.

4. The coating film transfer tool according to claim 3, wherein a front end of the protruding tip extends to a vicinity of the pressing edge portion.

5. The coating film transfer tool according to claim 4, wherein a distance between a front end of the pressing edge portion of the transfer head and the front end of the protruding tip is set to 0.3 mm to 8 mm.

6. The coating film transfer tool according to claim 5, wherein an extending direction of the pressing edge portion is perpendicular to rotation shafts of the feeding reel and the winding reel.

7. The coating film transfer tool according to claim 6, wherein the transfer head has a pair of tape guides arranged in left and right sides of the main body portion, each of the pair of tape guides has a lower tape guide arranged in a side where the transferable tape before transferring the coating film passes in the main body portion, and an upper tape guide arranged in a side where the transferable tape after transferring the coating film passes in the main body portion, and a gap between the pair of the upper tape guides is wider than a narrowest gap between the pair of the lower tape guides.

8. The coating film transfer tool according to claim 1, wherein the transfer head is pivotable about the protruding tip.

9. The coating film transfer tool according to claim 1, wherein a front end of the protruding tip extends to a vicinity of the pressing edge portion.

10. The coating film transfer tool according to claim 1, wherein a distance between a front end of the pressing edge portion of the transfer head and the front end of the protruding tip is set to 0.3 mm to 8 mm.

11. The coating film transfer tool according to claim 1, wherein an extending direction of the pressing edge portion is perpendicular to rotation shafts of the feeding reel and the winding reel.

12. The coating film transfer tool according to claim 1, wherein the transfer head has a pair of tape guides arranged in left and right sides of the main body portion, each of the pair of tape guides has a lower tape guide arranged in a side where the transferable tape before transferring the coating film passes in the main body portion, and an upper tape guide arranged in a side where the transferable tape after transferring the coating film passes in the main body portion, and a gap between the pair of the upper tape guides is wider than a narrowest gap between the pair of the lower tape guides.

13. A coating film transfer tool comprising:

a casing that houses a feeding reel around which a transferable tape before transferring a coating film is wound and a winding reel that winds the transferable tape after transferring the coating film; and a transfer head having a main body portion arranged in a front side which is one side of a front-rear direction of the casing to extend in a left-right direction perpendicular to the front-rear direction in a front end portion and provided with a pressing edge portion adapted for transferring the coating film to a transfer target surface, wherein the casing has a protruding tip that extends to the transfer head side and is connected to the transfer head, and wherein the protruding tip is configured to press a central part of the main body portion toward the transfer target surface side in the event of a transfer.

14. The coating film transfer tool according to claim 13, wherein a hole portion extending from a rear side to a front side of the longitudinal direction is provided in the central part of the main body portion, and the protruding tip is inserted into the hole portion.

15. The coating film transfer tool according to claim 13, wherein the transfer head is pivotable about the protruding tip.

16. The coating film transfer tool according to claim 13, wherein a front end of the protruding tip extends to a vicinity of the pressing edge portion.

17. A coating film transfer tool comprising:

a casing that houses a feeding reel around which a transferable tape before transferring a coating film is wound and a winding reel that winds the transferable tape after transferring the coating film; and a transfer head having a main body portion arranged in a front side which is one side of a front-rear direction of the casing to extend in a left-right direction perpendicular to the front-rear direction in a front end portion and provided with a pressing edge portion adapted for transferring the coating film to a transfer target surface, wherein a base member housed in the casing has a protruding tip that extends to the transfer head side and is connected to the transfer head, and wherein the protruding tip is configured to press a central part of the main body portion toward the transfer target surface side in the event of a transfer.

18. The coating film transfer tool according to claim 17, wherein a hole portion extending from a rear side to a front side of the longitudinal direction is provided in the central part of the main body portion, and the protruding tip is inserted into the hole portion.

19. The coating film transfer tool according to claim 17, wherein the transfer head is pivotable about the protruding tip.

20. The coating film transfer tool according to claim 17, wherein a front end of the protruding tip extends to a vicinity of the pressing edge portion.

* * * * *